United States Patent [19]

Willi

[11] Patent Number: 4,653,806

[45] Date of Patent: Mar. 31, 1987

[54] PIVOTALLY AND SLIDABLY CONNECTED CANTILEVERED SWIVEL SEAT

[75] Inventor: Hensel Willi, Willingen, Fed. Rep. of Germany

[73] Assignee: Mauser-Waldeck AG, Waldeck, Fed. Rep. of Germany

[21] Appl. No.: 684,778

[22] Filed: Dec. 21, 1984

[30] Foreign Application Priority Data

Jan. 14, 1984 [DE] Fed. Rep. of Germany ..... 8401000

[51] Int. Cl.[4] ..... A47C 3/00

[52] U.S. Cl. ..... 297/300

[58] Field of Search ..... 297/306, 301, 304, 305, 297/316, 320, 322, 328, 340

[56] References Cited

U.S. PATENT DOCUMENTS

| | | | |
|---|---|---|---|
| 2,321,385 | 6/1943 | Herold | 297/305 X |
| 2,398,072 | 4/1946 | Boerner | 297/305 |
| 2,441,251 | 5/1948 | Raitch | 297/316 |
| 2,463,257 | 3/1949 | Fox | 297/305 |
| 2,471,024 | 5/1949 | Cramer | 297/301 |
| 3,489,459 | 1/1970 | Katan et al. | 297/316 |
| 4,013,257 | 3/1977 | Paquette | 297/304 |
| 4,384,741 | 5/1983 | Flum et al. . | |
| 4,438,898 | 3/1984 | Knoblauch et al. | 297/304 |
| 4,479,679 | 10/1984 | Fries et al. | 297/300 |
| 4,509,793 | 4/1985 | Weismann et al. | 297/316 |

FOREIGN PATENT DOCUMENTS

| | | |
|---|---|---|
| 2748680 | 5/1979 | Fed. Rep. of Germany . |
| 2925520 | 1/1981 | Fed. Rep. of Germany . |

*Primary Examiner*—Francis K. Zugel

*Attorney, Agent, or Firm*—Pennie & Edmonds

[57] ABSTRACT

A chair with adjustable tilt, in which the seat of the chair is mounted with its front end in a pivoting and sliding bearing on a cantilever, the rear end of which is mounted on the chair column. The seat is further connected by a pivoting bearing directly to a backrest carrier. Tilting movement of the backrest carrier takes place against the force of tensioning springs which are connected at one end to engage the cantilever at the pivoting and sliding bearing and at the other end are connected to the seat.

7 Claims, 5 Drawing Figures

PIVOTALLY AND SLIDABLY CONNECTED CANTILEVERED SWIVEL SEAT

BACKGROUND OF THE INVENTION

1. Field of the Invention

The present invention relates to a swivel chair with adjustable tilt. It relates more particularly to a swivel chair having a cantilever, a seat that is pivotally and slidably connected to the cantilever, a backrest carrier pivotally connected to the seat and the cantilever, and springs connected between the cantilever and the seat so as to controllably contain the sliding of the cantilever with respect to the seat, and thus controllably contain the tilting of the backrest and seat of the chair.

2. Description of the Prior Art

German Offenlegungsschrift No. 29 25 520 describes a swivel chair in which a compact arrangement of the spring elements results in a space-saving design and a substantial simplification of the actuation lever system for the springs. A pivot bearing on the backrest carrier frame links it to the rear end of the seat support. The seat support is, in turn, pivotally mounted at its front end to the front end of a seat cantilever, which is connected at its rear end to the chair column. Also, horizontal struts at the lower end of the backrest carrier frame are linked by slide guides to the cantilever. This structure provides an advantageous tilt relationship between the seat, the back rest, and the other tilt members for proper back and pelvic support in all tilt positions. When the chair is tilted the seat support pivots about its mounting pivoting point on the cantilever, and the rear of the seat tilts downward as the backrest support tilts back.

Notwithstanding the advantages of such a swivel chair, its construction is relatively complicated and thus expensive. The backrest carrier is connected by slide guides to the cantilever and by a pivot mount to the seat support, causing the seat to tilt relatively little and pelvic support to remain substantially unchanged when the back is tilted. Keeping the position of the legs and pelvis unchanged while the back and seat are tilted can result in discomfort. When the seat and the chair back are pivoted, there should be a corresponding change in the location and direction of pelvic support.

The same holds true for the chair as described in U.S. Pat. No. 4,384,741, which corresponds to German Offenlegungsschrift No. 27 48 680. This patent employs mechanical tension springs rather than gas pressure springs as in the German Offenlegungsschrift No. 29 25 520 patent. The springs pivotally engage the front seat shell and the backrest carrier frame. Because of the particular lever conditions in such a spring arrangement, relatively strong springs must be used, which can impair tilting ease and seating comfort. Moreover, very short spring extensions are provided between the backrest carrier and the seat shell, which likewise necessitates the use of strong springs. With seat shell suspensions that are pivotable only in the front area, a double articulation must be employed between the rear of the seat shell and the backrest carrier. When the chair is tilted back into its farthest tilt position, this causes a substantial displacement between the rear edge of the seat shell and the lower backrest edge, which greatly impairs seating comfort and stretches the chair's upholstery.

SUMMARY OF THE INVENTION

An object of the invention is to provide a tilting mechanism for swivel chairs that will avoid the above disadvantages and create improved setting conditions both in the working position and the tilted position.

A cantilever is connected at its rear end to the swivelling chair column. The front end of the cantilever is pivotally and slidably connected to the front portion of a seat shell, and the rear end of the seat shell is pivotally connected to a backrest carrier. The backrest carrier, in turn, is pivotally mounted at its lower end on the cantilever near the chair column. When the seat back is tilted, the seat is drawn backward and tilted slightly downward by the backrest carrier. This motion is resisted by the force of tension springs connected between the front end of the cantilever and a point toward the rear of the seat shell. These points move away from one another longitudinally when the chair is tilted, thus increasing the tension on the springs to resist the tilting of the chair.

As a result of this mounting arrangement, a combination of motions occurs wherein the backrest tilts back and the seat tilts downward and extends rearward. The horizontal location of the front spring connection axis remains unaffected, while the spring rotates about this axis in the direction of the tilting motion and the seat is drawn back, thus extending the seating space rearward. This changes the back and pelvic support so as to improve the comfort of the person sitting in the chair. Also, the displacement between backrest and seat shell is reduced to a minimum.

Other objects, features, and advantages of the invention will be apparent from the following detailed description of a preferred embodiment, with reference to the accompanying drawings.

DETAILED DESCRIPTION OF A PREFERRED EMBODIMENT

Figure 1:
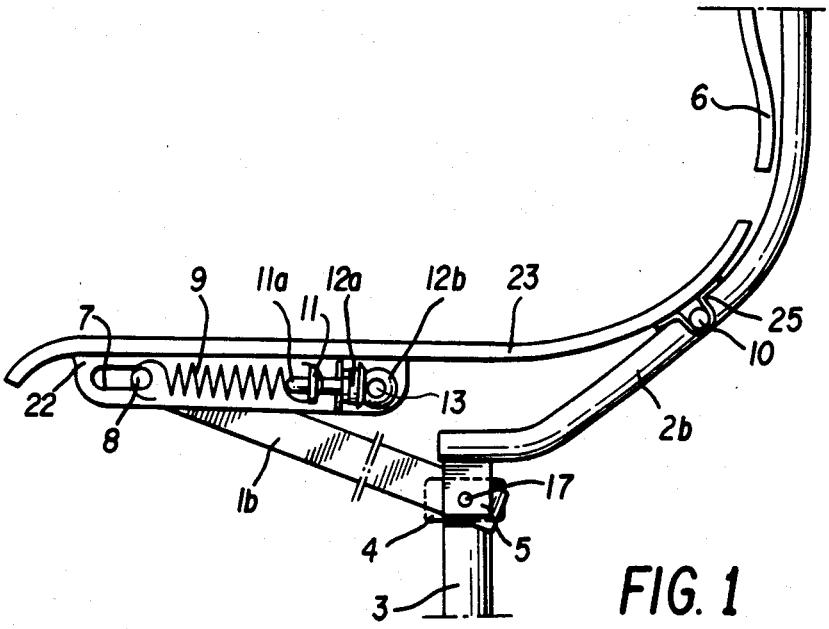
FIG. 1 is a diagrammatic cross-sectional view taken from line 1—1 of FIG. 3 showing a swivel chair in its upright position.
Figure 2:
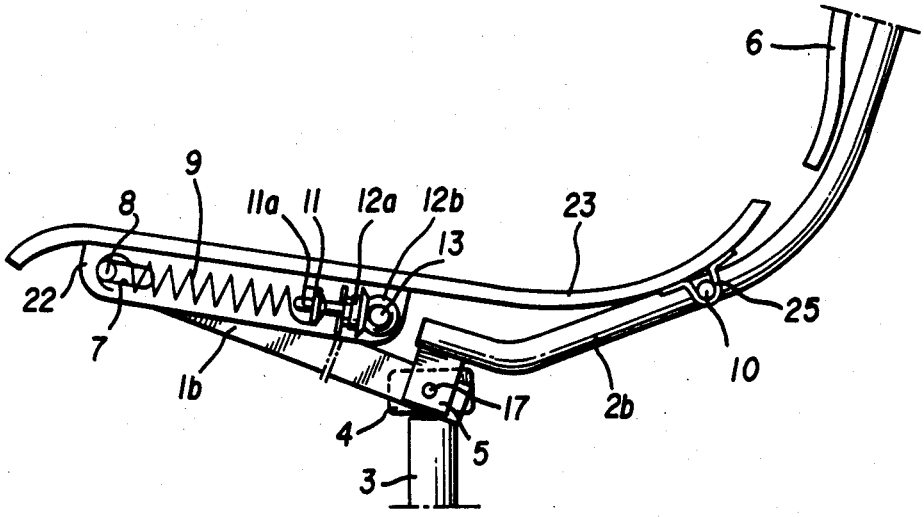
FIG. 2 shows a swivel chair as in FIG. 1 in its tilted position.
Figure 3:
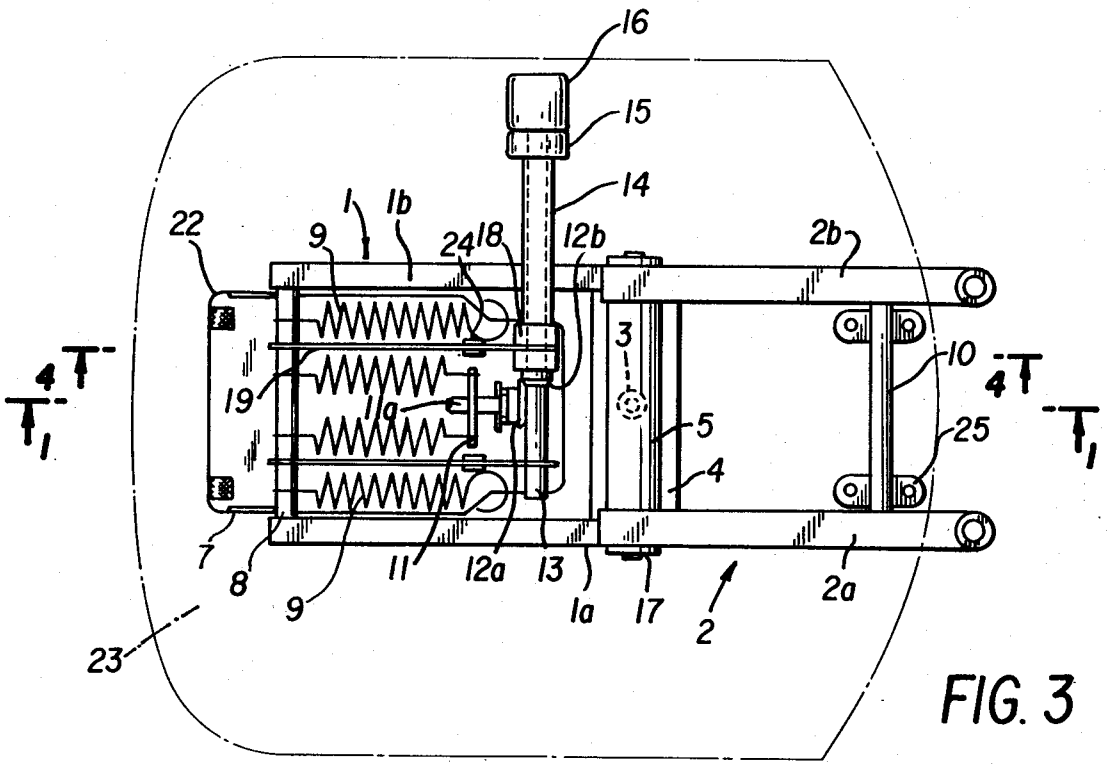
FIG. 3 is a top view of certain components of the swivel chair of FIG. 1.

Referring to FIGS. 1-3, a seat 23 is supported by a cantilever 1. The cantilever comprises left and right parallel arms 1*a* and 1*b*. These arms are rigidly joined with one another at their rear ends by a crosspiece 4. In the center of crosspiece 4 is a hole for accommodating the upper end of a swivelling seat column 3. The upper end of the lift rod is shown in phantom in FIG. 3.

A backrest carrier 2 comprises left and right parallel arms 2*a* and 2*b*, which are rigidly joined at their front ends via a crosspiece 5. The left and right ends of crosspiece 5 are bent downward. A pivot shaft 17 is connected between these ends of the crosspiece 5 to effect pivotal mounting thereof on the cantilever 1 at the top of the column 3. A separate backrest 6 is fastened in the upper area of the backrest carrier 2.

The front ends of the arms of cantilever 1 are rigidly joined with each other by a guide rod 8, which extends through longitudinal slots 7 in vertical side walls of a housing in the form of a spring box 22 fastened to the underside of seat or seat shell 23. The longitudinal slots 7 and guide rod 8 form a sliding linkage between the arms 1*a* and 1*b* and the spring box 22. The spring box 22 is disposed between the arms of cantilever 1. It extends from the front toward the rear of the seatshell and houses four tilt springs 9, spring tensioning means, and tilt locking means.

The front end of seat 23 and spring box 22 are mounted so that the cantilever pivots about guide rod 8 and the guide rod slides forward parallel to the seat as the chair is tilted. The seat 23 has bearings 25 in its rear area, which are pivotally mounted on a transverse shaft 10 fastened between the arms 2*a* and 2*b* of backrest carrier 2.

The tension springs 9 in spring box 22 are connected at their front ends to guide rod 8. At their rear ends, the two outer springs are connected to the rear walls of the spring box and the two inner springs are connected to a spring tensioning bar 11, which is also within spring box 22. The spring tensioning bar 11 is a transverse bar with an internally threaded medial hole. A threaded pin 11*a* is threaded longitudinally through the hole in bar 11, and at its rearward end is joined coaxially to a rearward-facing bevel wheel 12*a*. A transverse-facing bevel wheel 12*b* engages the wheel 12*a*, and is connected to one end of a horizontal transverse drive shaft 13. The other end of the drive shaft 13 passes through the right side of spring box 22 and carries a hand wheel 16. By moving the hand wheel, the tension of the two inner tensioning springs can be changed.

Figure 4:
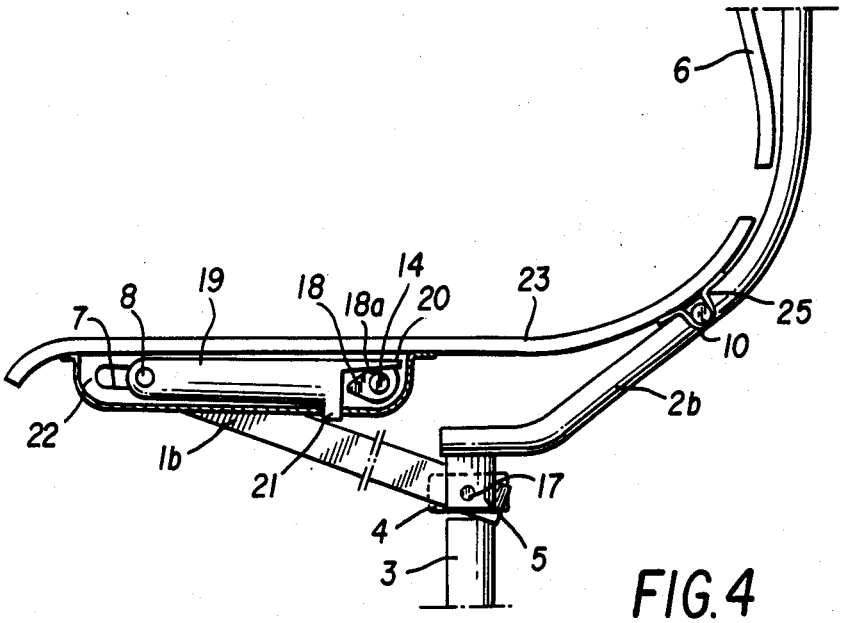
FIG. 4 is a diagrammatic view, partly in cross-section, taken from line 4—4 of FIG. 3 showing the tilt locking mechanism of a swivel chair as in FIG. 1 in its locked position.
Figure 5:
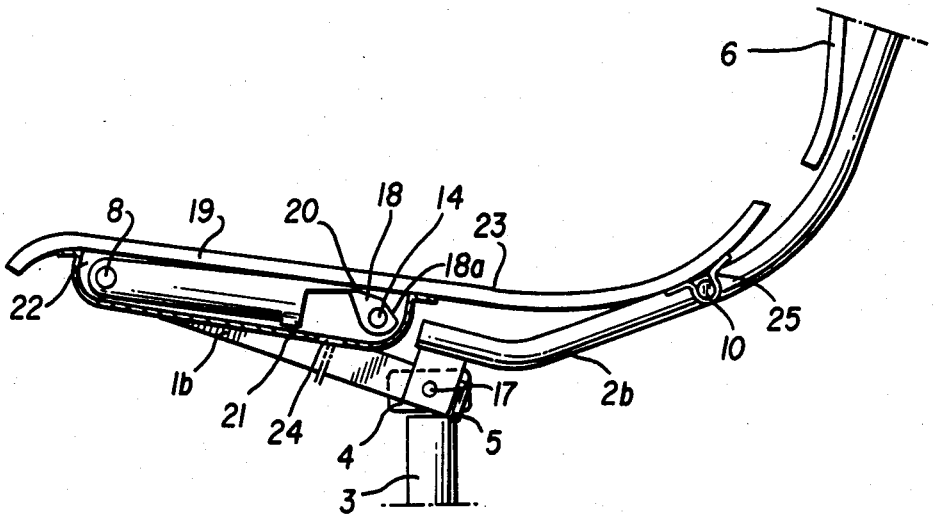
FIG. 5 shows a tilted swivel chair as in FIG. 2 with its tilt locking mechanism in an unlocked position.

Referring now to FIGS. 3–5, a cam and latch arrangement is provided to lock the swivel chair in an upright or tilted position. A hollow shaft 14 surrounding the drive shaft 13 extends from the outside to the inside of the spring box. The shaft 14 is rotated by a setting wheel 15 outside the spring box. A cam 18 is connected to the end of the shaft 14 inside the spring box. A latch 19 is pivotally connected at its forward end to guide rod 8 and at its rear end engages the cam 18. Latch 19 has a free rear end, which terminates in a horizontal bracket 20 projecting rearwardly over a flat face 18*a* of cam 18.

When cam 18 and latch 19 are in the locked position, as shown in FIG. 4, face 18*a* is horizontal, latch 19 is in its downward position and a stop pin 21 on the bottom of latch 19 drops into a hole 24 in the bottom of spring box 22. The hole 24 is seen most clearly in FIG. 5. The swivel chair cannot be tilted because the latch 19 blocks any movement of guide rod 8 in longitudinal slot 7, and thus blocks any pivoting movement of backrest carrier 2 about pivot shaft 17.

To unlock the swivel chair, wheel 15 is turned so as to rotate cam 18 upward against bracket 20, thus raising latch 19. This raises stop pin 21 out of hole 24, and the swivel chair can be tilted backward against the pull of springs 9. In this operation, backrest carrier 2 and shaft 10 draw seat 23 and spring box 22 backward, and guide rod 8 slides forward in longitudinal slots 7.

When the chair is in the tilted position, a negligible longitudinal displacement occurs between the lower edge of backrest 6 and the rear edge of seat 23. This displacement is so insignificant as to cause no discomfort even with unpadded seat or backrest designs. Also, as the chair is tilted, the area available for location of the hips is extended toward the rear, thus enhancing pelvic support and comfort in this position.

What is claimed is:

1. A chair with adjustable tilt comprising:
(a) a supporting seat column (3);
(b) a seal shell (23) having front and rear edges;
(c) a cantilever (1) having front and rear ends, the front end being mounted in a pivotal and slidable connection (7,8) with the seatshell (23) near said front edge, and the rear end being mounted on the seat column (3);
(d) a backrest carrier (2) having:
(i) a lower front end pivotally mounted on the rear end of the cantilever (1), and
(ii) a pivot bearing (10,25) spaced rearwardly from the front end of the backrest carrier (2), which pivotally supports the seatshell (23) near its rear edge, whereby tilting of the backrest carrier (2) causes pivotal and sliding motion of the seatshell (23) with respect to the cantilever (1);
(e) spring means connected between the cantilever (1) and the seatshell (23) for resisting said motion of the seatshell (23) with respect to the cantilever (1) and thereby resists tilting of the seatback carrier (2);
(f) said pivotal and slidable connection (7,8) between said cantilever (1) and said seatshell (23) including:
(i) a guide rod (8) transversely connected to the cantilever (1), and
(ii) means (7,22) connected to the seatshell (23) for pivoting and sliding engagement with said guide rod (8) at two transversely spaced points; and
(g) locking means selectively connecting said seatshell to said cantilever so as to prevent tilting motion of the chair, said locking means including:
(i) a latch (1) pivotally mounted at one end on said guide rod (8), and having pin means (21) near its other end,
(ii) hole means (24) on said seatshell for engaging said pin means so as to prevent movement of said guide rod with respect to said seatshell,
(iii) a cam (18) for selectively disengaging said pin means from said engaging means (24), and
(iv) a hollow shaft (14) substantially surrounding said drive shaft (13) and connected coaxially to said cam, for rotating said cam so as to selectively disengage said pin means (21).

2. A chair as in claim 1, wherein:
(a) the lower front end of the backrest carrier (2) is pivotally mounted on the rear end of the cantilever at a location in axial alignment with said seat column (3).

3. A chair as in claim 1, wherein:
(a) said backrest carrier (2) includes two arms (2*a*, 2*b*) which are joined at their front ends by transverse crosspiece means (5) pivotally mounted on said cantilever (1) near the rear end of said cantilever.

4. A chair as in claim 1, wherein:
(a) said spring means includes a plurality of tension springs (9), each of which is pivotally connected at one end to said guide rod (8) and at its other end to said seat shell (23).

5. A chair as in claim 4, further comprising:
(a) spring tensioning means linking at least one of said springs (9) to said seat shell (23) for adjusting the tension of said spring; said tensioning means including (1) movable bar means (11) attached to said other end of the spring and having a threaded hole;

(2) screw means (11*a*) fixed against axial movement and having threads engaging said threaded hole;

(3) transverse drive shaft means (13) rotatably mounted on the seat shell (23) and extending from the vicinity of the screw means (11*a*) to near one side of the seat shell; and (4) gear means for transmitting rotation of said drive shaft means (13) to said screw means (11*a*) so as to responsively move said bar means (11) for adjusting the tension on the spring.

6. A chair with adjustable tilt, comprising in combination:

(a) a supporting seat column (3);

(b) a seat shell (23) having front and rear edges;

(c) housing means (22) attached to said seat shell, said housing means having two vertical sidewalls, each extending from the front toward the rear of the seat shell (23) and having a longitudinal slot (7) formed therein near the front edge of the seat shell;

(d) a guide rod (8) disposed in each of said slots and longitudinally slidable therein;

(e) a cantilever (1) having front and rear ends, the front end being connected to said guide rod (8), whereby said cantilever is pivotally and slidably connected to said seat shell (23), the rear end of said cantilever (1) being connected to the seat column (3);

(f) a backrest carrier (2) having a front end pivotally mounted on said cantilever (1) near the rear end of said cantilever, and pivotally supporting the seat shell (23) near the rear edge of the seat shell;

(g) a plurality of tension springs (9) within said housing means (22) having first ends connected to said guide rod (8) and second ends connected to said housing means so that their tension increases with increased tilting of the backrest carrier (2) so as to resist such tilting;

(h) locking means selectively connecting said housing means (22) to said cantilever (1) so as to prevent tilting motion of the backrest carrier (2), including (i) a latch (19) pivotally mounted at one end on said guide rod (8), and having a pin (21) near its other end and, (j) a hole (24) in said housing means (22) engaging said pin (21) so as to prevent movement of said guide rod (8) with respect to said housing means (22);

(k) a cam (18) selectively engaging said latch (19) for disengaging said pin (21) from said hole (24); and (l) means for rotating said cam (18) so as to engage said latch (19).

7. A chair as in claim 6, further comprising:

(k) a cam (18) selectively engaging said latch (19) for disengaging said pin (21) from said hole (24); and (l) means for ratating said cam (18) so as to engage said latch (19).

* * * * *